United States Patent [19]

Khare

[11] Patent Number: 4,818,301

[45] Date of Patent: Apr. 4, 1989

[54] PROCESS FOR PRODUCING LARGE SECTION, LARGE MASS FORGED SLEEVES FROM LARGE DIAMETER INGOTS OF ALLOY 625 AND FROM HOT ISOSTATICALLY PRESSED PREFORMS OF ALLOY 625 POWDER

[75] Inventor: Ashok K. Khare, Warren, Pa.

[73] Assignee: National Forge Company, Irvine, Pa.

[21] Appl. No.: 123,805

[22] Filed: Nov. 23, 1987

Related U.S. Application Data

[63] Continuation-in-part of Ser. No. 879,479, Jun. 27, 1986, Pat. No. 4,714,498.

[51] Int. Cl.[4] ..... C22F 1/10

[52] U.S. Cl. ..... 148/11.5 N; 148/11.5 P; 148/427

[58] Field of Search ..... 148/2, 11.5 N, 11.5 P, 148/427

[56] References Cited

U.S. PATENT DOCUMENTS

| | | | |
|---|---|---|---|
| 1,437,690 | 12/1922 | Sylvester | 72/368 |
| 2,325,314 | 7/1943 | Harbart et al. | 29/156 |
| 3,260,095 | 7/1966 | Flanagan | 72/265 |
| 3,943,748 | 3/1976 | King, Jr. | 72/393 |

OTHER PUBLICATIONS

"Manufacture of Heavy Press Forging", Chap. 38, The Making, Shaping and Treating of Steel, (9th Ed., 1971), pp. 1042–1053.

"Open-Die Forging", Forging of Nickel Alloys, Metals Handbook: Forging and Casting, vol. 5, (8th Ed., 1970), pp. 41–48, 140–142.

Huntington Alloys, Inc., Brochure Entitled, "INCONEL Alloy 625".

*Primary Examiner*—R. Dean

*Attorney, Agent, or Firm*—Wayne M. Kennard

[57] ABSTRACT

A process for producing large section, large mass forged sleeves of alloy 625 comprising forming the workpiece from large, diameter ingots of alloy 625 or from hot isostatically pressed alloy 625 powder, saddle forging the workpiece, mandrel forging the workpiece, thermal treating the workpiece and finish machining the workpiece.

21 Claims, 1 Drawing Sheet

TREPANNED WORKPIECE

SADDLE FORGED WORKPIECE

MANDREL FORGED WORKPIECE

PROCESS FOR PRODUCING LARGE SECTION, LARGE MASS FORGED SLEEVES FROM LARGE DIAMETER INGOTS OF ALLOY 625 AND FROM HOT ISOSTATICALLY PRESSED PREFORMS OF ALLOY 625 POWDER

This is a continuation-in-part of copending patent application Ser. No. 879,479, filed June 27, 1986 now Pat. No. 4,714,498, 12/22/87.

TECHNICAL FIELD

The present invention relates to the field of processes for producing large section, large mass forged sleeves. More specifically, the present invention relates to a novel process of producing large section, large mass forged sleeves from large diameter ingots of alloy 625 and from hot isoslatically pressed preforms of alloy 625 powder.

BACKGROUND

Alloy 625 is a solid-solution matrix-stiffened face-centered-cubic alloy at elevated as well as room temperatures. The strength of alloy 625 is derived from the stiffening effect of molybdenum and columbium on its nickel-chromium matrix. High tensile, creep and rupture strength; outstanding fatigue and thermal-fatigue strength; oxidation resistance; excellent brazeability and weldability are some of the properties of this alloy. However, alloy 625 has a very small hot working temperature range; and even though it is austenitic at room temperature, it is an inherently stiff material and difficult to move, especially in large section sizes. In general, alloy 625 has good mechanical and physical properties for use as a wear surface and is resistant to salt water corrosion making it excellent for use in sea water applications. The specific properties of the alloy 625 are reported in a brochure entitled "INCONEL alloy 625" by Huntington Alloys, Inc., Huntington, W.Va., a manufacturer of alloy 625. (INCONEL is a registered trademark of International Nickel Co.)

Initially, alloy 625 was developed as a sheet metal and had applications limited to sheet and tubing uses. Once it was demonstrated it could be successfully forged, it had other applications consistent with conventional forging techniques.

A proposed application of alloy 625 forgings is as a protective sleeve on marine shafting to keep sea water from corroding the steel surface of such shafting. The advent of increased and expanded undersea exploration has made it highly desirable to have available for use as a high strength, corrosion resistant material which can be fabricated into structures (large section size and large mass), and/or used in rotating equipment. The operating conditions under which these large undersea structures and/or rotating equipment are subjected demand high and exacting multidirectional properties.

Using conventional metal working methods, alloy 625 sleeves could be formed by rolling the material into a plate, forming the plate into a sleeve, and seam welding the plate. However, the seam weld would be a potential failure point for the sleeve. Prior to the present invention, all alloy 625 forgings were limited to small section size and small mass. Production of alloy 625 sleeves using forged parts employing conventional methods was directed to forging small or standard diameter ingots into rings. Large section, large mass sleeves formed from these rings required welding two or more forged rings together to form the final sleeve. These sleeves also suffered from the existance of welds in the finished product.

Huntington Alloy Inc. has produced large diameter remelted ingots of alloy 625 with a diameter of approximately 40 inches suitable for making large section, large mass forged seamless sleeves. However, there has been no process or method by which to work the material to form a large section, large mass forged sleeve from such ingots. The inherent stiffness of alloy 625, coupled with the very small hot working temperature range and the grain growth phenomenon of alloy 625 at elevated temperatures, made alloy 625 difficult to work to produce a large section, large mass forged products and still meet the high and directionally uniform mechanical properties desired in such a forged product.

Powder technology relating to hot isostatically pressing ("HIPping") alloy 625 has resulted in the production of small preforms not approaching the size of the workpieces from which the finished large section, large mass cylindrical sleeves of the present invention are produced. There has been great difficulty in producing HIPped alloy 625 powder preforms with sufficient properties that will result in the finished large section, large mass cylindrical sleeve having the desired properties after being worked. Even if the HIPped alloy 625 preforms were made of a sufficient size to be the starting workpieces for the large section, large mass cylindrical sleeves of the present invention, the workpieces would be difficult to work and still meet the high and directionally uniform mechanical properties desired on the finished forged product.

The technology developed by the present invention not only overcomes the problem of producing large section, large mass forged sleeves from large diameter ingots of alloy 625 and HIPped workpieces made from alloy 625 powder, but also provides the specific thermomechanical procedures developed to provide uniformly high mechanical properties, high ductility and a high fatigue limit in a product used in the corrosive sea water environment.

SUMMARY OF THE INVENTION

The present invention is a process of producing large section, large mass forged sleeves from remelted ingots of alloy 625 having a diameter of 40 inches produced by Huntington Alloy Inc., Huntington, W.Va., and from HIPped workpieces made from alloy 625 powder.

In the novel process of the present invention, the workpieces from which the large section, large mass cylindrical sleeves are made can be formed by two methods. In the first method, the workpiece is formed from a 40 inch diameter ingot of alloy 625. In the second method, the workpiece is formed from by HIPping alloy 625 powder to the desired starting shape.

According to the first method of workpiece formation, the 40 inch diameter ingot of alloy 625 first has a small slice saw cut from the toe end of the "as cast" ingot which is a bottom discard of the ingot. After removal of the small slice, the first sawed end is faced. After facing, the ingot is trepanned with a bore having a 12 ½ inch diameter and a depth of 26 inches.

Following trepanning, the toe ⅓ is saw cut transverse to the longitudinal axis of the ingot at a distance from the first sawed end equal to the depth of the trepan bore, which in this case is 26 inches. The second saw cut separates the workpiece, which is to form the large section, large mass forged sleeve, from the remaining portion of the ingot. After separating the workpiece from the remainder of the ingot, the second sawed end of the workpiece is faced.

According to the second method of workpiece formation, alloy 625 powder is HIPped to form a preform which is 26 inches long with a bore equivalent in diameter to the trepan bore discussed above and with an outside diameter equivalent to the outside diameter of the workpiece formed by the first method.

After the workpiece is formed by either method, the workpiece is saddle forged. In saddle forging the workpiece, the inside diameter of the workpiece is opened to 24 inches and the outside diameter increases to 44 inches but the length remains the same.

After saddle forging, the workpiece is mandrel forged. In mandrel forging the workpiece, the workpiece nominally has an inside diameter of 24 inches (because the mandrel forging mandrel is slightly tapered), the outside diameter is decreased to 31 ½ inches and the length is increased to 76 inches.

Following mandrel forging the workpiece is thermal treated, then finish machined to form the large section, large mass forged sleeve suitable for its desired use.

An object of the present invention is to produce a large section, large mass forged sleeve from a large diameter ingot or HIPped preform made from alloy 625 powder.

A further object of the invention is to produce a large section, large mass forged sleeve from a 40 inch diameter ingot of alloy 625 or HIPped preform made from alloy 625 powder.

These and other objects will be described in greater detail in the remaining portions of the specification.

BEST MODE FOR CARRYING OUT THE INVENTION

The present invention is a novel process for producing large section, large mass forged sleeves from 40 inch diameter ingots of alloy 625 or HIPped preforms of alloy 625 powder.

The limiting chemical composition by weight percentage of alloy 625, as reported in the brochure entitled "INCONEL alloy 625" by Huntington Alloy Inc., Huntington, W.Va., is shown in Table 1.

TABLE 1

| Element | % by Weight |
|---|---|
| Nickel | 58.0 min. |
| Chromium | 20.0–23.0 |
| Iron | 5.0 max. |
| Molybdenum | 8.0–10.0 |
| Columbium (plus Tantalum) | 3.15–4.15 |
| Carbon | 0.10 max. |
| Manganese | 0.50 max. |
| Silicon | 0.50 max. |
| Phosphorus | 0.015 max. |

TABLE 1-continued

| Element | % by Weight |
|---|---|
| Sulfur | 0.015 max. |
| Aluminum | 0.40 max. |
| Titanium | 0.40 max. |
| Cobalt (if determined) | 1.0 max. |

The physical and mechanical properties of and forging temperature ranges for alloy 625 are reported in the Huntington Alloy Inc. brochure and the "Forging of Nickel Alloys", *Metals Handbook,* Vol. 5 *Forging and Casting,* (8th Ed. 1970), pp. 139 to 142, respectively, and would be understood by one skilled in the art without further disclosure herein.

In the novel process of the present invention, the workpiece from which the large section, large mass forged sleeve can be formed by two methods. According to the first method, the workpiece is formed by cutting a member from the toe end of the 40 inch diameter alloy 625 ingot. Although the toe ⅓ of the ingot is selected as the portion of the ingot from which to produce the large section, large mass forged sleeve, it is understood that the mid-length and head sections of the ingot can also be used.

Next, a small slice is cut from the end of the toe end of the ingot. The slice is used to discard the chemistry check drill holes made to evaluate the chemistry of the remelted ingot. This first sawed surface is then faced in the conventional manner.

Once the first saw cut is made and the end faced, the ingot is trepanned. The first sawed trepanned bore has a 12 ½ diameter and a depth of 26 inches.

Following trepanning, the 40 inch diameter alloy 625 ingot is cut a second time to separate the workpiece, from which the sleeve is to be formed, from the remainder of the ingot. The second saw cut is made approximately 26 inches from the first sawed end of the ingot, which is the distance from the first sawed end equal to the depth of the trepan bore. Once the second saw cut is made, in substantially the same manner as the first saw cut, the workpiece is separated for the remainder of the ingot.

After separation of the workpiece, the second sawed end is faced in the conventional manner. Once the second sawed end is faced, the workpiece has the cross-sectional shape shown at 100 in FIG. 1. At this point in the process, the workpiece at 100 has an inside diameter at 120 of 12 ½ inches, an outside diameter at 122 of 40 inches and a length at 124 of 26 inches.

Figure 1:
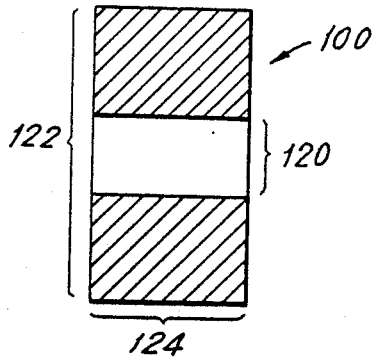
FIG. 1 shows a cross-sectional view of a workpiece formed according to the methods of workpiece formation according to the present invention.

According to the second method of workpiece formation, alloy 625 powder is HIPped to form the workpiece shown at 100 in FIG. 1. This workpiece, like the workpiece formed by the first method, has an outside diameter of 40 inches, a length of 26 inches, and a bore with an diameter of 12 ½ inches.

Figure 2:
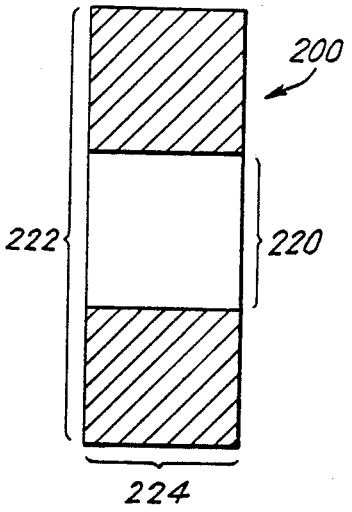
FIG. 2 shows a cross-sectional view of a representative example of a saddle forged workpiece according to the process of the invention workpiece prior to mandrel forging.

Subsequent to the formation of the workpiece as shown at 100 in FIG. 1 by either method, the workpiece is saddle forged to the shape shown at 200 in FIG. 2. In saddle forging the workpiece, the inside diameter of the workpiece at 220 is opened to 24 inches and the outside diameter at 222 increases to 44 inches while maintaining at 224 the same length of the 26 inches.

Preferably, the saddle forging mandrel is a conventional three step diameter mandrel with steps of 10 inches, 12 inches and 16 inches. Before the workpiece is placed on the saddle forging mandrel, the mandrel is preheated to a temperature of 800° F., and should be at least 600° F. when the workpiece is placed on it.

The pressing die used in saddle forging the workpiece is applied to the workpiece with the total force of the press of the die, which is 3000 tons. The pressing die must be of a width so that the full length of the workpiece is pressed when the die is brought into contact with the workpiece to prevent elongation of the workpiece in the longitudinal direction in carrying out saddle forging.

In saddle forging step, the workpiece is heated to 2125° F., placed on saddle forge mandrel and worked with the saddle forging die until the workpiece stops moving. There is no lower forging temperature limit, it is only when the workpiece stops moving that it must be reheated for more work. In saddle forging the workpiece, the workpiece is rotated on the mandrel by a manipulator in steps, and at each step the workpiece is worked between the die and the mandrel supported on horses sitting on the floor. When the workpiece is rotated to each successive step, it is rotated an amount which allows for an overlap of the new step's press location with the previous step's press location. The saddle forging working step is repeated for the number of heats required to achieve the desired saddle forging dimensions of the workpiece.

During saddle forging, all press work on workpiece is done in the presence of gas burners impinging on both sides of the workpiece to control the rate of cooling of the workpiece.

Figure 3:
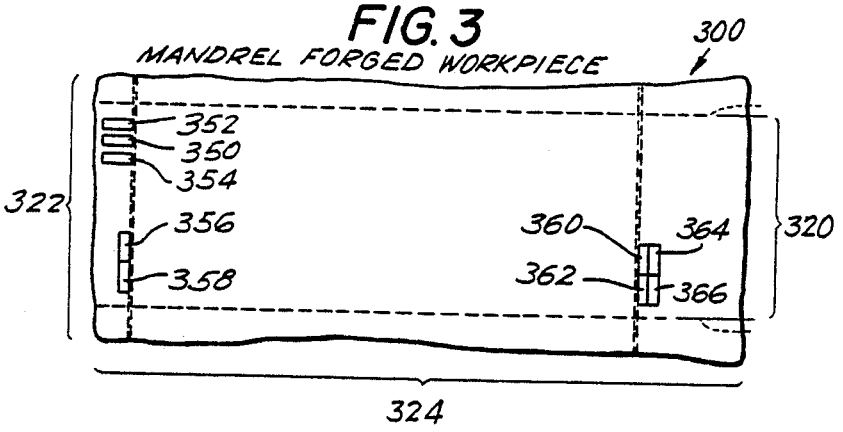
FIG. 3 shows a representative example of an actual mandrel forged workpiece prior to finish machining produced according to the process of the invention with the tensile test locations shown therein.

After saddle forging, the workpiece is mandrel forged. In mandrel forging, the workpiece is placed on the mandrel forging mandrel and worked with a flat top die and bottom "V" die to produce, as shown in FIG. 3 at 300, a workpiece with an inside diameter at 320 of nominally 24 inches (because the mandrel forging mandrel is slightly tapered), an outside diameter at 322 of 31 ½ inches and a length at 324 of 76 inches.

Prior to commencing mandrel forging, the mandrel forging mandrel is preheated so that it is at least 800° F. when the workpiece is placed on it. Following preheating of the mandrel forging mandrel just prior to placing the workpiece on it, the outside surface of mandrel forging mandrel has a lubricant placed on it. Also, the temperature of the mandrel must be maintained between 600° F. and 800° F. between mandrel forging heats.

The top and bottom forging dies used for working the workpiece preferably have widths of 6 inches. However, it is contemplated that dies having 18 inches widths can be used, but if dies with 18 inch widths are used, during the last heat it is preferable to use dies with 6 inch widths.

Prior to mandrel forging the workpiece, the top and bottom dies should be preheated to a temperature of at least 700° F. and the temperature of bottom "V" die must be maintained between 600° F. and 800° F. between mandrel forging heats.

In mandrel forging the workpiece, the workpiece is heated to 2125° F., placed on the mandrel forging mandrel and worked between the flat top and bottom "V" forging dies, with the press of the forging dies applying a maximum pressure of 3000 tons to the workpiece. The workpiece is pressed until its stops moving. This procedure is repeated until the workpiece has a wall thickness of 5 inches. Once a 5 inch wall thickness is reached, the procedure is changed and for each heat the workpiece is reheated 2000° F., placed on the mandrel forging mandrel and worked between the forging dies by applying a maximum pressure of 3000 tons to the workpiece. Again the workpiece is pressed until it stops moving. Once the 5 inch wall thickness is reached, work is not imparted to the workpiece until after the temperature of the workpiece has dropped below 1900° F. following reheat.

Mandrel forging is started mid-length along the longitudinal length of the workpiece, or can be started at least one die width from the end of the workpiece. From this starting point, the forging dies are moved in steps up or down the workpiece. At each step, except at the starting location, a manipulator axially rotates the workpiece in increments, and at each rotation increment of the workpiece, the workpiece is pressed by the forging dies. When the workpiece is rotated to each successive increment, it is rotated an amount which allows an overlap of the new rotation increment's press location with the previous rotation increment's press location. The mandrel forging dies press the workpiece at each rotation increment until the workpiece is rotated 360° in a given step. After being rotated 360° at a step, the mandrel forging dies are moved up or down the workpiece to the next step which is ½ or ¾ of a die width. This procedure is continued throughout each heat until the final desired mandrel forging dimensions are achieved. The working of the workpiece in the first step is the same as the other steps except that the workpiece is rotated twice instead of once before the dies are moved to the second step.

Once the mandrel forging is complete and the desired mandrel forging dimensions are achieved, the workpiece is allowed to air cool to room temperature prior to thermal treatment.

During mandrel forging the mandrel forging mandrel is also water cooled. Water cooling is normally commenced after about 10 minutes die time and continued throughout the remainder of the heat.

The mandrel forging working step is carried out in the presence of gas burners on both sides of the workpiece to control its rate of cooling. Gas burners are also positioned adjacent on both sides of the bottom "V" die to maintain the desired temperature of the bottom "V" die.

Thermal treatment for mechanical properties followed by annealing at 1700° F. is carried out on the "as forged" workpiece. Thermal treatment and annealing is accomplished according to the Huntington Alloy, Inc. brochure which would be understood by one skilled in the art without further explanation herein.

Following thermal treatment, the workpiece is finish machined to the finished large section, large mass forged sleeve of alloy 625.

Large section, large mass forged sleeves produced according to the present invention have fine and uniformly controlled grain size and high mechanical properties in both the tangential and longitudinal directions after annealing.

Experiment

A large section, large mass forged sleeve was produced from a 40 inch ingot of alloy 625 according to the process of the present invention. The saddle forging step was carried out in 2 heat and the mandrel forging step was carried out in 16 heats. A chemistry check of the starting 40 inch diameter alloy 625 ingot and the large section, larger mass forged sleeve produced from the ingot is shown in Table 2.

TABLE 2

| | Ingot | Sleeve |
|---|---|---|
| Nickel | 63.09 | 62.80 |
| Chromium | 21.27 | 21.05 |
| Iron | 3.11 | 3.43 |
| Manganese | 0.21 | 0.16 |
| Carbon | 0.01 | 0.006 |
| Molybdenum | 8.19 | 8.38 |
| Columbium | 3.36 | 3.41 |
| Silicon | 0.23 | 0.15 |
| Aluminum | 0.19 | 0.062 |
| Titanium | 0.34 | 0.28 |
| Sulfur | 0.001 | 0.002 |
| Phosphorus | 0.007 | 0.008 |
| Cobalt | | 0.043 |

The results of a tensile test at locations indicated in FIG. 3 of the sleeve produced according to the process of the present invention prior to finish machining is shown in Table 3. These tests show high ductility and uniformity of material including grain size from end to end in both the longitudinal and tangential directions.

TABLE 3

| Location No. | Orientation | Tensile (ksi) | 0.2% Yield (ksi) | % EL | % RA |
|---|---|---|---|---|---|
| 350 | Longitudinal | 113.0 | 63.5 | 61.0 | 56.0 |
| 352 | Longitudinal | 112.8 | 67.5 | 62.0 | 54.1 |
| 354 | Longitudinal | 112.8 | 63.8 | 63.0 | 56.0 |
| 356 | Tangential | 113.9 | 66.0 | 55.0 | 52.2 |
| 358 | Tangential | 115.6 | 68.1 | 51.5 | 49.1 |
| 360 | Tangential | 112.1 | 64.1 | 53.0 | 51.7 |
| 362 | Tangential | 112.9 | 65.7 | 54.5 | 52.5 |
| 364 | Tangential | 115.4 | 67.6 | 56.5 | 53.2 |
| 366 | Tangential | 112.9 | 64.6 | 57.0 | 51.4 |

Large section, large mass forged sleeves produced according the the present invention subsequent to the sleeve produced in the Experiment above, yielded sleeves having tensile strength uniformity throughout exceeding 120.0 ksi, a 0.2% yield above 65.0 ksi, a % EL above 40.0, and a % RA above 45.0

The terms and expressions which are employed herein are used as terms of expression and not limitation. And, there is no intention, in the use of such terms and expressions, of excluding the equivalents of the features shown, and described, or portions thereof, it being recognized that various modifications are possible in the scope of the invention.

I claim:

1. A process for producing large section, large mass forged sleeves of alloy 625 consisting essentially of a limiting composition by weight percentage of 58.0 min. nickel, 20.0–23.0 chromium, 5.0 max. iron, 8.0–10.0 molybdenum, 3.15–4.15 columbium (plus tantalium), 0.10 max. carbon, 0.50 max. manganese, 0.50 max. silicon, 0.015 max. phosphorus, 0.015 max. sulphur, 0.40 max. aluminum, 0.40 titanium, and 1.0 max. cobalt (if determined), comprising the steps of:

(a) forming a workpiece by hot isostatically pressing alloy 625 powder to a shape having a predetermined outside diameter, length, and central bore size;

(b) saddle forging the workpiece which further comprises the substeps of, (1) heating the workpiece to a temperature of 2125° F., (2) placing the workpiece on a preheated saddle forging mandrel, (3) working the workpiece by rotating the workpiece in steps with a first manipulator means and at each step applying a saddle forging die having a width substantially the same as the total length of the workpiece, with the saddle forging die applying a pressure of 3000 tons to the workpiece until the workpiece stops moving when the saddle forging die is applied, and rotating the workpiece for each successive step an amount to allow an overlap of a new step's press location with the previous step's press location;

(4) reheating the workpiece to a temperature of 2125° F. and repeating step (b)(3) until the bore in the workpiece is opened to a predetermined diameter;

(c) mandrel forging the saddle forged workpiece which further comprises the substeps of, (1) heating the workpiece to a temperature of 2125° F., (2) placing the workpiece on a preheated mandrel forging mandrel, (3) working the workpiece with a preheated top mandrel forging die and a preheated bottom mandrel forging die by moving the workpiece in its axial direction in steps, with each step being a portion of a mandrel forging die width, and at each step axially rotating the workpiece with a second manipulator means in increments until the workpiece is rotated at least 360° at each step, with the mandrel forging dies applying a maximum pressure of 3000 tons to the workpiece at each increment of axial rotation of the workpiece at each step, with each increment of axial rotation being an amount to allow an overlap of a new rotation increment's press location with the previous rotation increment's press location, and working the workpiece until it stops moving when the mandrel forging dies are applied, (4) reheating the workpiece to 2125° F. and repeating step (c)(3) until a predetermined length of the workpiece is achieved, (5) air cooling the workpiece to room temperature;

(d) thermal treating the workpiece followed by annealing the workpiece; and (e) finish machining the workpiece to form the finished large section large mass forged sleeve.

2. The process as recited in claim 1, wherein the saddle forging step further comprises carrying out substeps (b)(3) and (b)(4) in the presence of a plurality of gas burners impinging upon the workpiece to control the rate of workpiece cooling.

3. The process as recited in claim 1, wherein the mandrel forging step further comprises carrying out substeps (c)(3 ) and (c)(4) in the presence of a plurality of gas burners impinging upon the workpiece to control the rate of workpiece cooling.

4. The process as recited in claim 1, wherein the saddle forging step further comprises saddle forging with a 3-step diameter saddle forging mandrel.

5. The process as recited in claim 1, wherein forming the workpiece by hot isostatically pressing includes forming a workpiece approximately 26 inches in length with an outside diameter of approximately 40 inches and a bore having a diameter of approximately 12 ½ inches.

6. The process as recited in claim 1, wherein the saddle forging step further comprises saddle forging the workpiece to an outside diameter of approximately 44 inches and an inside diameter of approximately 24 inches.

7. The process as recited in claim 1, wherein the mandrel forging step further comprises mandrel forging the workpiece to an outside diameter of approximately 31 ½ inches, an inside diameter of nominally 24 inches and a length of approximately 76 inches.

8. The process as recited in claim 1, wherein the saddle forging step further comprises preheating the saddle forging mandrel to a temperature of at least 600° F. before substep (b)(2).

9. The process as recited in claim 1, wherein the mandrel forging step further comprises preheating the mandrel forging mandrel to a temperature of at least 800° F. before substep (c)(2).

10. The process as recited in claim 1, wherein the mandrel forging step further comprises working the workpiece with a flat top die and a bottom "V" die during substep (c)(3), and in repeating substep (c)(3) in substep (c)(4).

11. The process as recited in claim 10, wherein the mandrel forging step further comprises working the workpiece with a flat top die and a bottom "V" die having widths of 6 inches.

12. The process as recited in claim 10, wherein the mandrel forging step further includes working the workpiece with a flat top die and a bottom "V" die having widths of 18 inches.

13. The process as recited in claim 1, wherein the mandrel forging step further comprises preheating the top and bottom dies to a temperature of at least 700° F. before substep (c)(3).

14. The process as recited in claim 1, wherein the mandrel forging step further comprises maintaining the bottom mandrel forging die at a temperature between 600° F. and 800° F. between substeps (c)(3) and (c)(4), and in repeating the cycle according to substep (c)(4).

15. The process as recited in claim 1, wherein the mandrel forging step further comprises maintaining the mandrel forging mandrel at a temperature between 600° F. and 800° F. between substeps (c)(3) and (c)(4), and in repeating the cycle according to substep (c)(4).

16. The process as recited in claim 1, wherein the mandrel forging step further comprises lubricating the outside surface of the mandrel forging mandrel before substep (c)(2).

17. The process as recited in claim 1, wherein the mandrel forging step further comprises water cooling the mandrel forging mandrel during at least a portion of substep (c)(3).

18. The process as recited in claim 1, wherein the mandrel forging step further comprises working the workpiece according to substeps (c)(3) and (c)(4) until the workpiece has a wall thickness of 5 inches and thereafter working the workpiece by the substeps of:

(a) reheating the workpiece to a temperature of 2000° F.;

(b) placing the workpiece on the preheated mandrel forging mandrel;

(c) cooling the workpiece from the reheat temperature of 2000° F. to a temperature of 1900° F.;

(d) working the workpiece with the preheated top mandrel forging die and preheated bottom mandrel forging die by moving the workpiece in its axial direction in steps, with each step being a portion of the die width, and at each step axially rotating the workpiece with the second manipulator means in increments until the workpiece is rotated at least 360° at each step, with the mandrel forging dies applying a maximum pressure of 3000 tons to the workpiece at each increment of axial rotation of the workpiece at each step, with each increment of axial rotation being an amount to allow an overlap of a new rotation increment's press location with the previous rotation increment's press location, and working the workpiece until it stops moving when the mandrel forging dies are applied; and (e) repeating steps (a), (b), (c) and (d) until the predetermined length of the workpiece is achieved.

19. The process as recited in claim 1, wherein the saddle forging step further comprises imparting work to the workpiece in the circumferential direction.

20. The process as recited in claim 1, wherein the mandrel forging step further comprises imparting work to the workpiece in the longitudinal direction.

21. A process as recited in claim 1, wherein the large section, large mass forged hollow cylindrical sleeves produced from alloy 625 have a fine and uniformly controlled grain size, and high mechanical properties in both the tangential and longitudinal directions after annealing.

* * * * *

UNITED STATES PATENT AND TRADEMARK OFFICE

CERTIFICATE OF CORRECTION

PATENT NO. : 4,818,301

DATED : April 4, 1989

INVENTOR(S) : Ashok K. Khare

It is certified that error appears in the above-identified patent and that said Letters Patent is hereby corrected as shown below:

Col. 1, line 18 "isoslatically" should be -- isostatically --

Col. 2, line 54 After "from" insert -- preform --

Col. 4, line 31 Before "end" insert -- first sawed --

Col. 4, line 32 After "The" delete "first sawed"

Col. 6, line 64 "heat" should be -- heats --

Signed and Sealed this

Nineteenth Day of March, 1991

*Attest:*

HARRY F. MANBECK, JR.

*Attesting Officer*

*Commissioner of Patents and Trademarks*